US005312035A

United States Patent [19]

Nold et al.

[11] Patent Number: 5,312,035

[45] Date of Patent: May 17, 1994

[54] PACKAGING CONTAINER

[75] Inventors: Richard P. Nold; Uwe A. Nold, both of Gross-Gerau, Fed. Rep. of Germany

[73] Assignee: Real-Pack Entwicklungs und Verpackungstechnik GmbH, Gross-Gerau, Fed. Rep. of Germany

[21] Appl. No.: 691,032

[22] PCT Filed: Dec. 6, 1989

[86] PCT No.: PCT/EP89/01496

§ 371 Date: May 28, 1992

§ 102(e) Date: May 28, 1992

[87] PCT Pub. No.: WO90/07455

PCT Pub. Date: Jul. 12, 1990

[30] Foreign Application Priority Data

Dec. 28, 1988 [DE] Fed. Rep. of Germany ..... 3844110

[51] Int. Cl.[5] ..... B65D 5/18

[52] U.S. Cl. ..... 229/104; 229/116; 229/193

[58] Field of Search ..... 229/104, 111, 116, 137, 229/193; 206/436

[56] References Cited

U.S. PATENT DOCUMENTS

| | | | |
|---|---|---|---|
| 2,232,088 | 2/1941 | Waters | 229/104 |
| 2,323,287 | 7/1943 | Amberg | 229/193 |
| 2,935,238 | 5/1960 | Koehler | 229/104 |
| 3,079,062 | 2/1963 | Craddock et al. | 229/116 |
| 3,317,118 | 5/1967 | Harrison et al. . | |
| 4,020,988 | 5/1977 | Kipp | 229/193 |
| 4,063,679 | 12/1977 | Henry | 229/116 |
| 4,194,676 | 3/1980 | Humphries | 229/193 |
| 4,260,097 | 4/1981 | Nold | 229/116 |
| 4,981,257 | 1/1991 | Rodbruch | 229/193 |
| 5,098,014 | 3/1992 | Perkins | 229/116 |

FOREIGN PATENT DOCUMENTS

| | | | |
|---|---|---|---|
| 534852 | 7/1955 | Belgium . | |
| 2509052 | 9/1976 | Fed. Rep. of Germany | 229/116 |
| 918469 | 2/1947 | France | 229/193 |
| 586070 | 3/1947 | United Kingdom | 229/193 |

*Primary Examiner*—Gary E. Elkins

*Attorney, Agent, or Firm*—Burns, Doane, Swecker & Mathis

[57] ABSTRACT

A packaging container comprises a one-piece blank of cardboard or the like. The container has side walls which are joined to a base. The base comprises two main triangular panels which rise from a common diagonal fold, and each main triangle panel is connected via an intermediate triangular panel to the edges of the base. Longitudinal edge strips disposed on opposite longitudinal edges of the container body are secured to each other to close the sides of the container.

19 Claims, 4 Drawing Sheets

FIG. 1
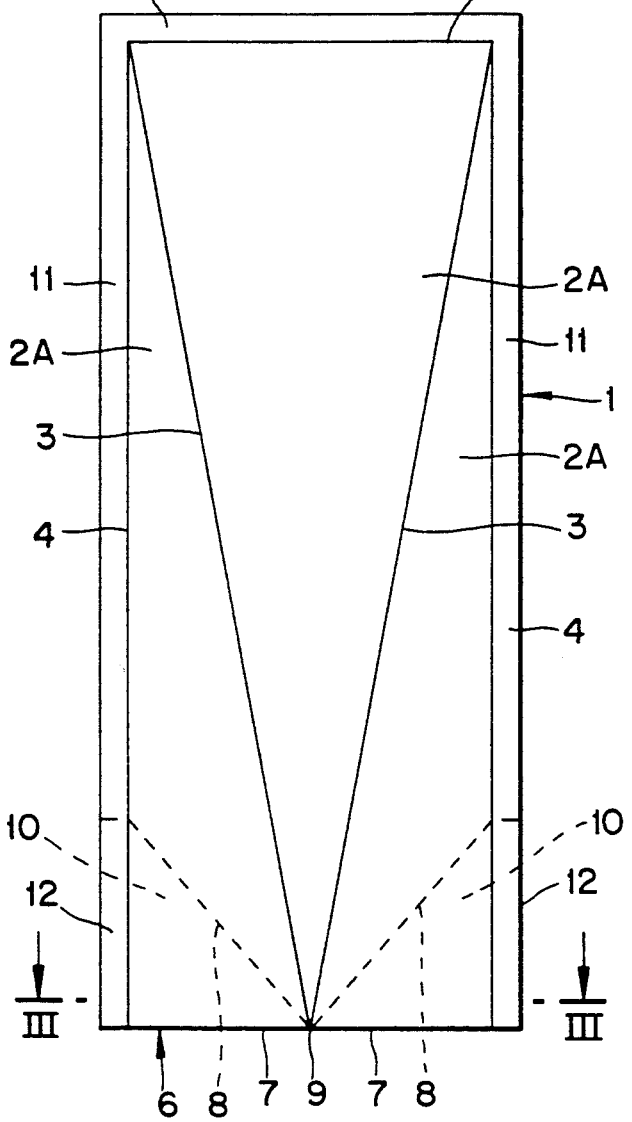
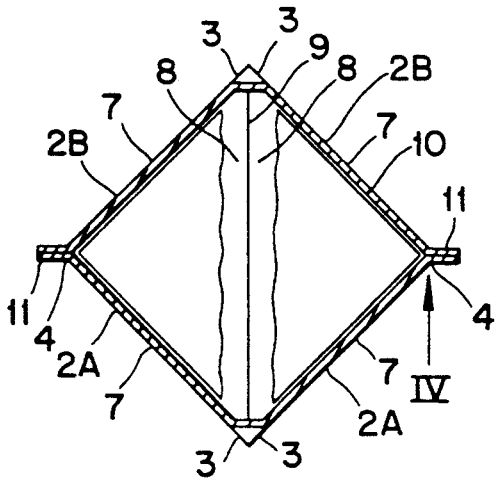
FIG. 3
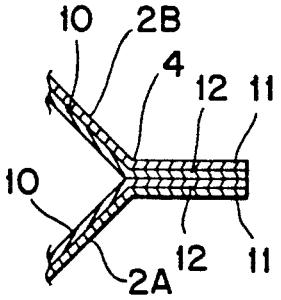
FIG. 4

PACKAGING CONTAINER

BACKGROUND OF THE INVENTION

The invention concerns a packaging container made of a one-piece cut-out blank of an essentially rigid sheet material, in particular, cardboard with a container body consisting of side walls connected at the longitudinal edges with each other and with a common rectangular base at four bottom edges.

Packaging containers of this fundamental design are known in different form of realization, for example as folding boxes, the container bottom of which is formed by a closure with insert straps or adhesively bonded closing flaps. Although folding boxes may be used in very broad fields of application, they are not suitable for example for tight, internally coated containers for liquids.

For the latter purpose, butt-ended bags made of plastic-metal composite sheets are used, which are folded while forming a container bottom in a manner such that they are in contact only with their coated insides and therefore may be made tight by edge sealing. However, the mechanical stability of such bags is low in view of the flexibility of the composites used. Their use is therefore restricted to liquids.

In a known packaging container of the abovementioned generic type (EP 16 848), the rectangular container bottom, which is also the support surface for the packaging container, is in the form of a container closure, preferably as a conventional folding box insert strap closure. The stability of this known packaging container is determined essentially by the strength of the closure forming the container bottom. Although the inherent stability of the upwardly tapering container body is very high and would permit the use of a relatively thin material, the configuration of the closure at the container bottom requires a certain minimum thickness and rigidity of the material used. In addition, this known packaging container may be used in the manner of a folding box only in view of its bottom closure, i.e. not as a tightly welded packaging container for liquids or flowable goods.

It is therefore the object of the invention to develop a packaging container of the abovementioned type so that it may be used for very different purposes, in particular as a container for liquids or flowable goods. The packaging container is to combine the advantageous properties of a folding box with those of a butt-ended bag, without their respective disadvantages.

SUMMARY OF THE INVENTION

This object is attained according to the invention by that the container bottom consists of two bottom triangles, which rise from a common diagonal fold to two diametrically opposed longitudinal edges and are connected by an intermediate triangle each with the bottom edges, said intermediate triangle abutting against the inside of a side wall, that the adjacent side walls are connected at these longitudinal edges with each other by means of longitudinal edge strips and that the cut-out parts forming the container bottom are located in the center section of the cut-out.

By means of the bottom configuration according to the invention, which consists of the center of the single-part cut-out without indentations, a container bottom with a very high inherent strength is created, which therefore also provides the container body and thus the entire packaging container with an increased stability. For this reason, relatively thin materials may be used.

The container bottom obtains this particular inherent stability on the one hand by that it consists of triangles joined with each other in a foldable manner, said triangles being laid out spatially, and on the other, by that the longitudinal edge strips of the side walls in particular also in the bottom area are placed upon and connected with each other, preferably also with edge strips joined to the intermediate triangles, as provided for in a preferred form of embodiment of the concept of the invention.

An essential advantage of the packaging container according to the invention is based on the fact that in all joint locations only inner sides of the packaging materials are in contact, i.e. a flat joint of the edge strips. It is possible in this manner to provide the cut-out with a hot sealable coating on one side to seal the edge strips placed upon each other in a liquid tight fashion. This simultaneously insures that the contents of the container, for example a liquid, is in contact with said coating only. It is thus possible to use the packaging container according to the invention in the form of a butt-end container as packaging for a liquid for the immediate inclusion of the liquid. The liquid container created in this manner has a high inherent stability and a good standing ability, so that liquid packages of this type may be in the form of significantly larger units as in the case of sheet butt-end bags.

The packaging container according to the invention is further suitable for the packaging of other bulk goods, for example granular or powder material, wherein different configurations are possible for the upper closure of the container. While in the case of packaging for liquids an upwardly tapering shape terminating in a narrow, hot-sealable closure appears to be advantageous, other forms of the container body, for example a parallelepiped with a rectangular, square, diamond shaped or other base configuration may also be used, wherein the upper closure of the container may consist of a conventional insert lash or a closure formed by two sealed triangles.

In the upward tapering form of embodiment the packaging container according to the invention is primarily also suitable for use as a pouring container for liquids or bulk materials; the contents may be removed through a special closure or by cutting off an upper corner of the container. In a similar manner, the packaging container may also be used as a tube for fill goods in the paste form, which may be discharged through the closure or the cut-off corner. If no internal coating is provided, it is possible to contain liquids by placing an internal plastic bag into the cardboard container, for example in the form of tubular sections.

BRIEF DESCRIPTION OF THE DRAWINGS

In the following, examples of embodiment are described with reference to the drawing, wherein FIG. 1 shows a packaging container in a front elevation, FIG. 2 the packaging container of FIG. 1 in a lateral elevation, FIG. 3 a section on the line III—III in FIG. 1, FIG. 4 an enlarged sectioned view in the area designated IV in FIG. 3, FIG. 5 the cut-out used in the production of the packaging container according to FIG. 1 to 4, FIG. 6 an isometric spatial view of a modified form of embodiment of a packaging container, FIG. 7 the cut-out used in the preparation of the packaging container of FIG. 6, FIG. 8 a partial view of the center area of a cut-out for a packaging container modified relative to FIG. 6.

DETAILED DESCRIPTION OF A PREFERRED EMBODIMENT OF THE INVENTION

Figure 2:
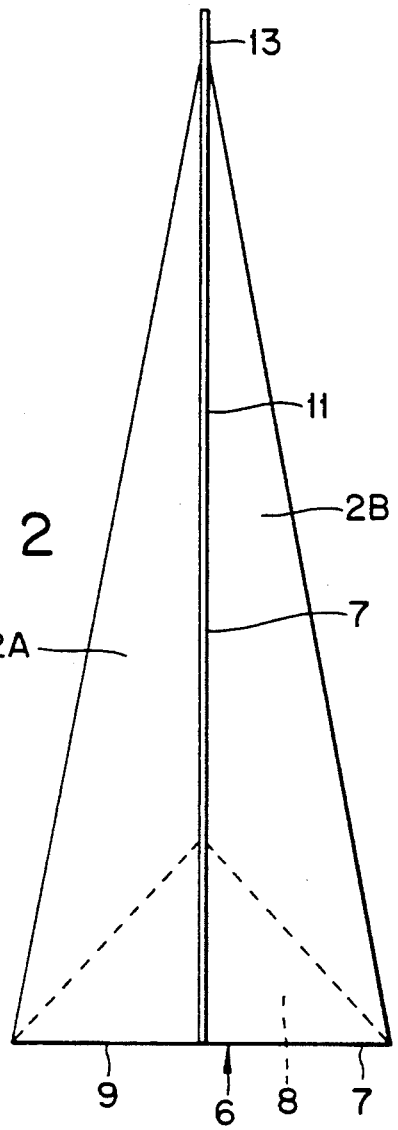

The packaging container shown in FIG. 1 to 4 consists of a one piece cut-out (FIG. 5) of cardboard, carton or another essentially rigid sheet material. The body 1 of the container is formed by first and second side walls. The first side wall is defuned by three side wall panels 2A, and the second side wall is defined by three side wall panels 2B. The panels of each side wall are joined together at the longitudinal edges 3 and 4. The container body 1 tapers upward in the example of embodiment according to FIG. 1 to 4 into a narrow container closure 5.

At the lower end of the packaging container a rectangular container bottom 6 is formed, which constitutes the support surface of the packaging container 1. The bottom 6 includes the four bottom edges 7 from which the side wall panels 2A, 2B extend upwardly.

The container bottom 6 consists of two bottom main panels shaped as triangles 8. They are connected with each other by a diagonal fold 9 located in the base plane of the bottom and rise from there to the two diametrically opposed longitudinal edges 4.

Each bottom triangle 8 is connected with the two associated bottom edges 7 by means of two folding intermediate panels in the form of triangles 10 articulated onto them, with said intermediate triangles abutting against the inside of a side wall 2.

At the diametrically opposite longitudinal edges 4 the adjacent side walls are joined to each other on the longitudinal edge strips 11 placed upon each other, for example by adhesive bonding or sealing, for which ultrasonic or high frequency hot sealing processes may be used in the conventional manner.

The intermediate triangles 10 are also connected with each other in a folding manner at their outer edge with an edge strip 12. As seen in the enlarged sectioned view in FIG. 4, these two edges strips 12 are placed upon each other and between the longitudinal edge strips 11, to which they are joined in the aforedescribed manner.

FIG. 1 shows that along the upper container closure 5 there are again two edge strips 13 located upon each other and joined together, so that the entire packaging container is tightly closed.

Figure 5:
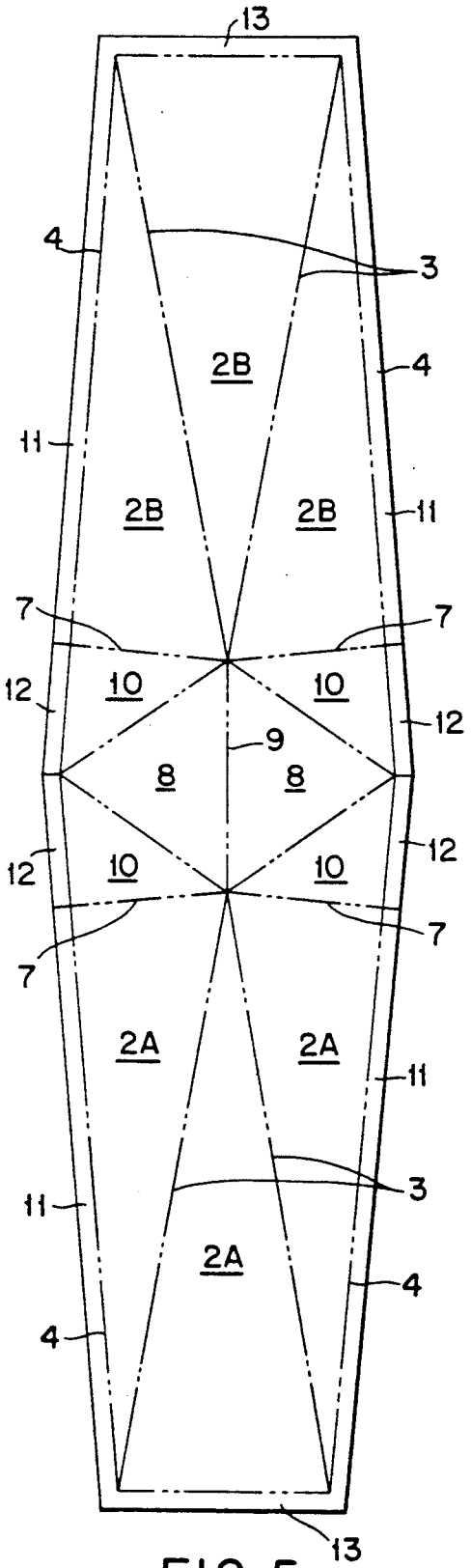

In the view of the cut-out in FIG. 5 the position of the aforedescribed container parts may be seen. It is perceived that all of the container parts are connected only by folding edges and that there are no indentations inside the cut-out or from its edges. The container bottom 6 is formed by the center area of the cut-out.

The packaging container shown as an example of embodiment in FIG. 1 to 4 may contain for example a powder or a liquid, such as a liquid detergent or motor oil and may be emptied after cutting. When used as a packaging container, preferably a cut-out provided on one side with a liquid tight and sealable coating is employed. It is seen from the configuration described of the packaging container that only the one, preferably coated side of the cut-out is in contact with the goods to be packaged and that all of the edge strips 11, 12 and 13 to be connected with each other again contact each other on the one, preferably coated side only. The properties of the packaging container make it possible to obtain a stable configuration for barrier layers with the lowest possible material expenditure.

As seen in FIG. 5, the two edge strips 12 of adjacent intermediate triangles 10 and the connecting longitudinal edge strips 11 form on each of the two side of the cut-out a continuous cut-out edge strip interrupted only by folding edges, said cut-out edge strips passing at the upper end of the container, i.e. at the two cut-out ends, directly into the upper edge strip 13.

Figure 6:
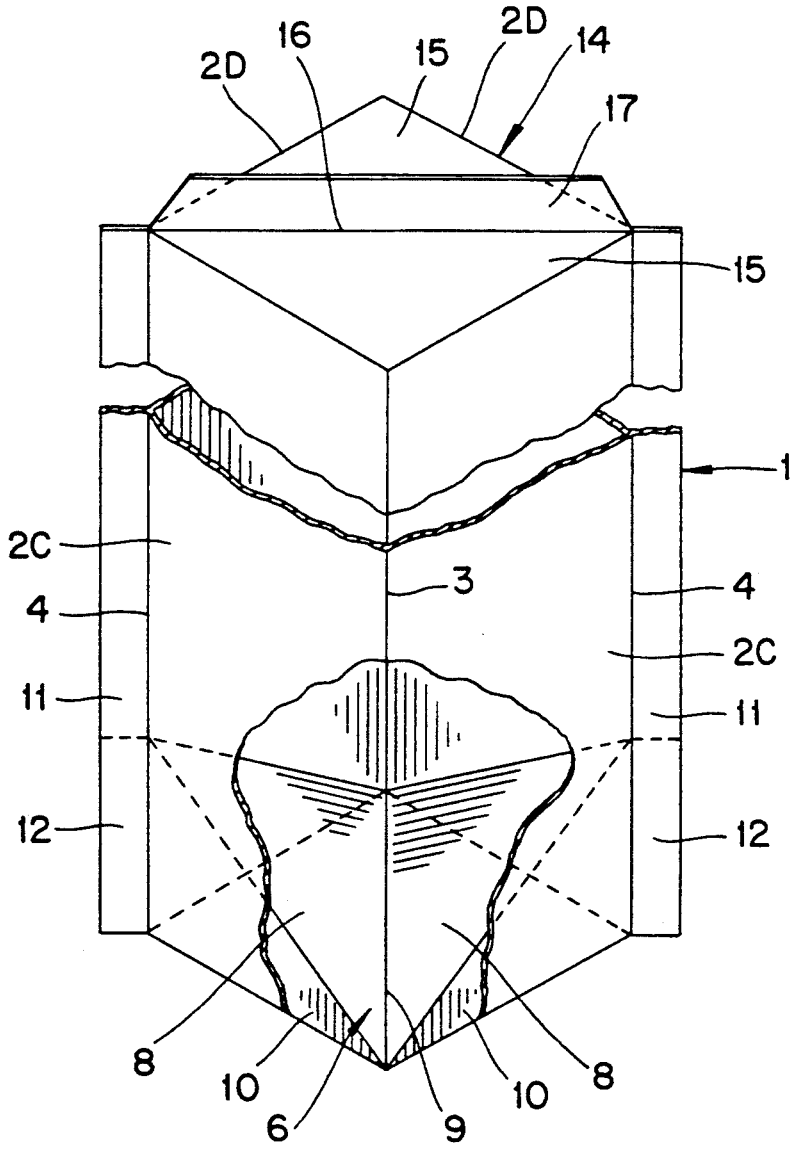

The packaging container according to FIG. 6 differs from the aforedescribed upward tapering container by that it is parallelepipedic in shape, i.e. the longitudinal edges 3 and 4 are vertical and parallel to each other. The container bottom 6 is constructed in the manner described above. For better recognition, the packaging container in FIG. 6 is partially broken up and shown in an isometric perspective manner. The individual cut-out parts carry the same reference symbols as in FIG. 1 to 5.

A first side wall comprises two side wall panels 2C, and a second side wall comprises two side wall panels 2D. The longitudinal edges 3 and 4 extend to the edges of a rectangular upper container closure 14, which consists of two triangular closing flaps 15 connected with the side walls 2 and joined together along a closing diagonal 16. This closing diagonal 16 connects the upper ends of the two longitudinal edges 4. For this purpose each of the two closure flaps 15 has at the closing diagonal 16 an edge strip 17, which are connected with each other.

From the view of the cut-out (FIG. 7) used for the packaging container according to FIG. 6, it is seen that the closure flaps 15 are foldingly connected with the adjacent side walls 2 by means of a two-part filling wedge 18. For the rest, the cut-out according to FIG. 7 is similar to the cut-out of FIG. 5, especially in the center area forming the bottom 6 of the container, so that identical reference symbols are used.

In place of the container closure 14 shown in FIG. 6, a conventional insertion strap way also be used, so that the packaging container may be opened and closed at its upper closure in the manner of a folding box.

Figure 8:
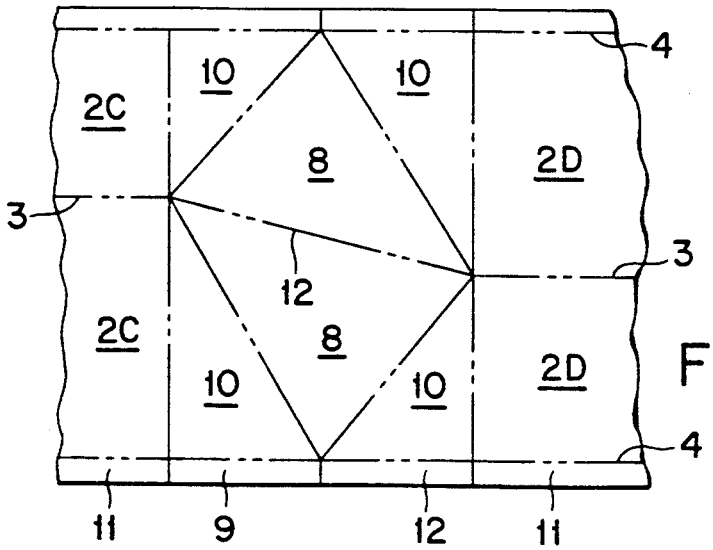
Figure 7:
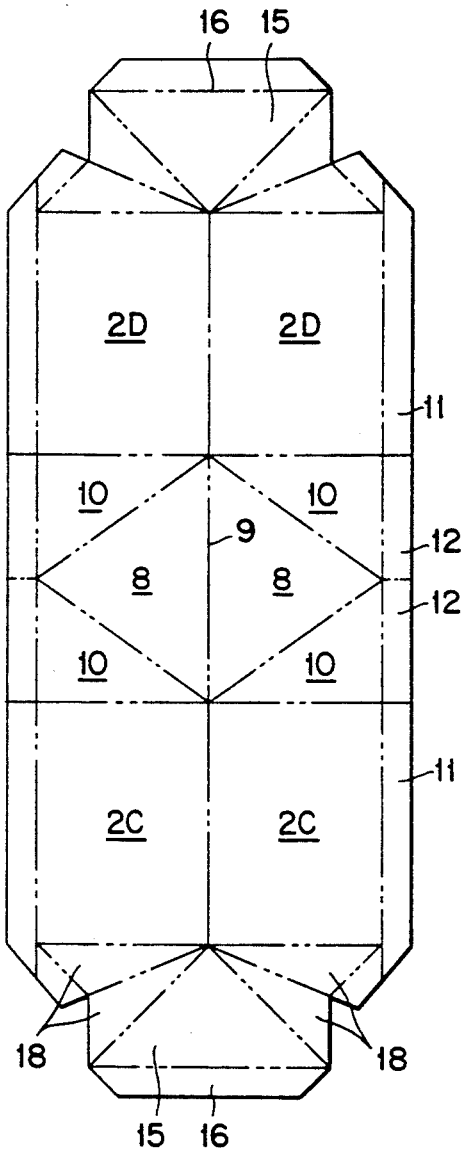

FIG. 8 shows in a modification of FIG. 7 a cut-out for the packaging container with a rectangular plane projection. The parts of the cut-out are identified by the same symbols as in FIG. 5 and 7.

We claim:

1. A packaging container formed of a one-piece blank of essentially rigid sheet material, said container comprising first and second side walls; each side wall including a pair of edge strips extending in generally longitudinal directions; each edge strip of said first side wall being pressed together with an edge strip of said second side wall and secured thereto to define a longitudinal edge of said container; each of said first and second side walls defining two bottom edges; said two bottom edges of said first side wall lying in a common plane with said two bottom edges of said second side wall; intermediate triangular panels extending upwardly from respective ones of said bottom edges, with each bottom edge defining a first fold line between one of said intermediate triangular panels and a respective side wall; each of said intermediate triangular panels abutting an inside surface of its respective side wall; a pair of main triangular panels defining a bottom of said container, each main triangular panel being joined along two of its edges with two of said intermediate triangular panels; an third edge of each main triangular panel lying in said common plane and defining a second fold line between said two main triangular panels; each of said main triangular panels being inclined downwardly from a respective one of said longitudinal edges to said second fold line.

2. A packaging container according to claim 1, wherein each of said first and second side walls comprises at least two panels forming an angle relative to one another.

3. A packaging container according to claim 1, wherein one end of said second fold line intersects a junction of said two bottom edges of said first side wall, and another end of said second fold line intersects a junction of said two bottom edges of said second side wall.

4. A packaging container according to claim 1, wherein each of said intermediate triangular panels includes an edge strip sandwiched between said edge strips of said first and second side walls and secured thereto.

5. A packaging container according to claim 3, wherein said edge strips defining each of said longitudinal edges comprise: an edge strip of said first side wall, an edge strip of said second side wall, and two edge strips of said intermediate triangular panels, all forming a continuous side strip of said blank.

6. A packaging container according to claim 1, wherein said first and second side walls are joined together at their upper edges to form a closure, said longitudinal edges extending upwardly to respective ends of said closure.

7. A packaging container according to claim 6, wherein said closure is formed by two interconnected upper edge strips of said side walls.

8. A packaging container according to claim 1, wherein said bottom edges form a rectangle.

9. A packaging container according to claim 8, wherein said bottom edges form a square.

10. A packaging container according to claim 1, wherein said bottom edges form a diamond.

11. A packaging container according to claim 1, wherein said longitudinal edges are parallel to one another.

12. A packaging container according to claim 1, wherein said side walls converge upwardly.

13. A packaging container according to claim 1, wherein each of said first and second side walls forms two upper edges, said upper edges of said first and second side walls lying in a common plane.

14. A packaging container according to claim 13 including first and second closing flaps extending toward one another from upper ends of said first and second side walls respectively, said upper edges defining fold lines between said closing flaps and their respective side walls, said closure flaps being secured together.

15. A packaging container according to claim 14, wherein each of said closure flaps includes an edge strip abutting an edge strip of the other closure flap and secured thereto.

16. A packaging container according to claim 15, wherein said edge strips of said closure flaps are secured together by hot sealing.

17. A packaging container according to claim 4, wherein one side of said blank has a hot sealable coating, said edge strips of said side walls and said edge strip of said intermediate triangular panels being joined together by hot sealing.

18. A packaging container according to claim 1 including a plastic bag disposed inside of said blank.

19. A packaging container according to claim 18, wherein said plastic bag is tubular.

* * * * *